United States Patent [19]

Colleran et al.

[11] Patent Number: 4,693,536

[45] Date of Patent: Sep. 15, 1987

[54] INSULATION DISPLACEMENT TERMINAL

[75] Inventors: Stephen A. Colleran, Lisle; Connie Doles, La Grange Park, both of Ill.

[73] Assignee: Molex Incorporated, Lisle, Ill.

[21] Appl. No.: 873,574

[22] Filed: Jun. 12, 1986

[51] Int. Cl.[4] ..... H01R 4/24

[52] U.S. Cl. ..... 439/404

[58] Field of Search ..... 339/97 R, 98 R, 97 P, 339/99 R, 103

[56] References Cited

U.S. PATENT DOCUMENTS

| | | | |
|---|---|---|---|
| 4,047,785 | 9/1977 | Jayne | 339/99 R |
| 4,074,929 | 2/1978 | Krider | 339/97 R |
| 4,519,663 | 5/1985 | De Luca | 339/99 R |

FOREIGN PATENT DOCUMENTS

| | | | |
|---|---|---|---|
| 1483981 | 8/1977 | United Kingdom | 339/97 R |

*Primary Examiner*—Gil Weidenfeld

*Assistant Examiner*—Glenn L. Webb

*Attorney, Agent, or Firm*—Louis A. Hecht; John W. Cornell

[57] ABSTRACT

An electrical terminal adapted to be mounted in a connector housing cavity for interconnecting an insulated conductor and a contact member includes an insulation displacement contact portion adapted to receive the insulated conductor and a second contact portion adapted to make electrical contact with the contact member. A connecting portion extends between the insulation displacement contact portion and the second contact portion. The insulation displacement contact portion is generally U-shaped with a base and spaced first and second legs. The connecting portion extends from an end of the first leg. A first insulation displacement slot is provided in the first leg and extends into said connecting portion and a second insulation displacement slot is provided in said second leg.

6 Claims, 9 Drawing Figures

INSULATION DISPLACEMENT TERMINAL

BACKGROUND OF THE INVENTION

1. Field of the Invention

The present invention relates to electrical terminals, and more particularly to an improved terminal for making insulation displacement connections to insulation clad wires.

2. Description of the Prior Art

Insulation displacement terminals are widely used to make electrical connections with insulated conductors because the step of removing insulation from the conductor prior to termination is eliminated. Dutch Patent No. 67,298 issued Feb. 15, 1951 discloses various insulation displacement terminals; at FIGS. 8–10 terminals having at least two insulation displacement slots in a linear array as shown.

U.S. Pat. No. 4,527,852 discloses an insulation displacement terminal of a type that is useful with a range of conductor sizes or gauges. This terminal is configured to receive and terminate an insulated conductor with its axis at a right angle with the major axis of the terminal. Although this terminal is useful for its intended purpose, a need exists for an electrical terminal for making an insulation displacement connection to an insulation conductor and a contact member that is simple in construction and economical in manufacture and that is configured for high density applications and as an in-line terminal and that is adapted to a stamping die progression in which the center-to-center spacing is equal to the center-to-center spacing of cavities of a terminal housing.

SUMMARY OF THE INVENTION

Among the important objects of the present invention are to provide an improved electrical terminal for interconnecting an insulated conductor and a contact member; to provide such a terminal having smaller space requirements than terminals used for this purpose in the past; and to provide such a terminal configured for terminating the insulated conductor with its axis aligned with a major axis of the terminal.

In brief, in accordance with the above and other objects of the invention, there is provided an electrical terminal adapted to be mounted in a connector housing cavity for interconnecting an insulated conductor and a contact member. The terminal has an insulation displacement contact portion adapted to receive the insulated conductor and a second contact portion adapted to make electrical contact with the contact member. A connecting portion extends between the insulation displacement contact portion and the second contact portion. The insulation displacement contact portion is generally U-shaped with a base and spaced first and second legs. The connecting portion extends from an end of the first leg. A first insulation displacement slot is provided in the first leg and extends into said connecting portion and a second insulation displacement slot is provided in said second leg.

BRIEF DESCRIPTION OF THE DRAWINGS

The present invention together with the above and other objects and advantages may be best understood from the following detailed description of the preferred embodiment of the invention illustrated in the drawings, wherein.

DETAILED DESCRIPTION OF THE PREFERRED EMBODIMENT

Figure 1:
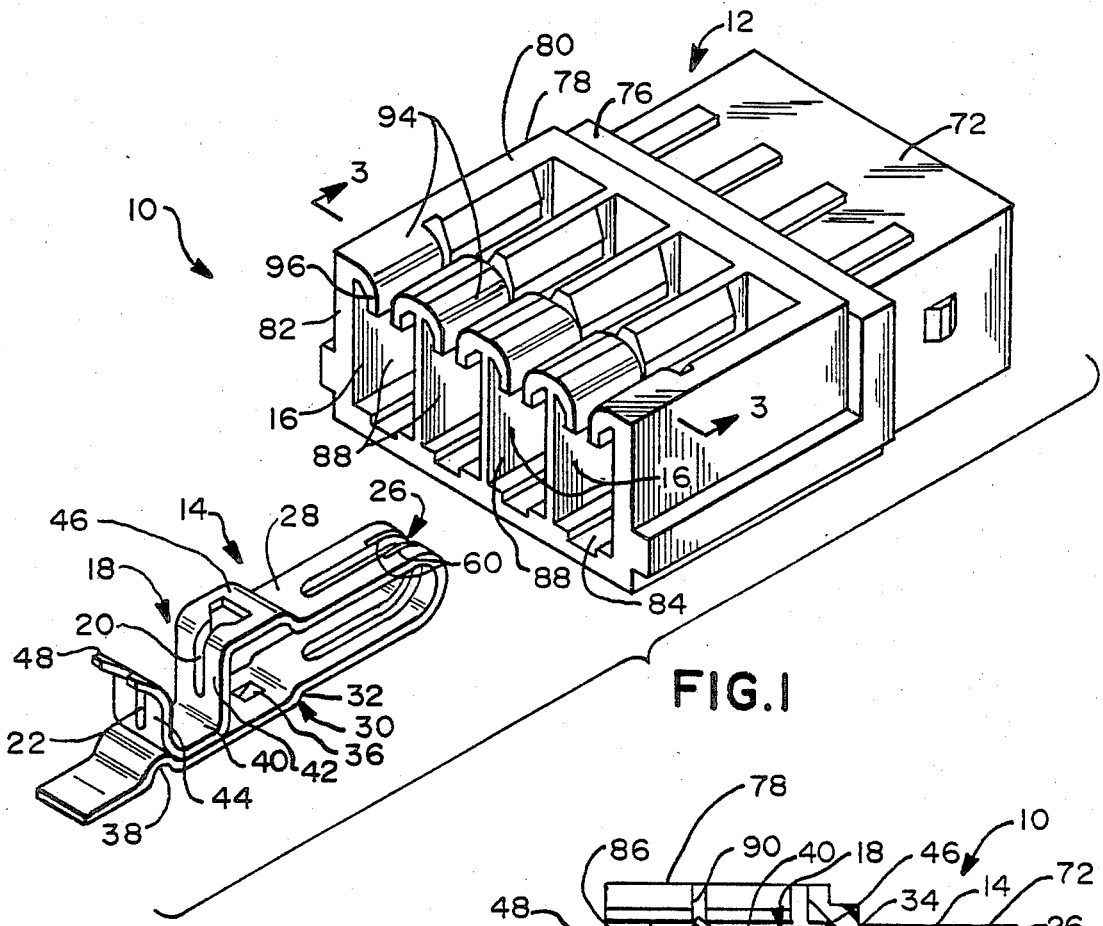
FIG. 1 is an exploded perspective view of an electrical connector having a housing and a terminal constructed in accordance with the present invention.
Figure 2:
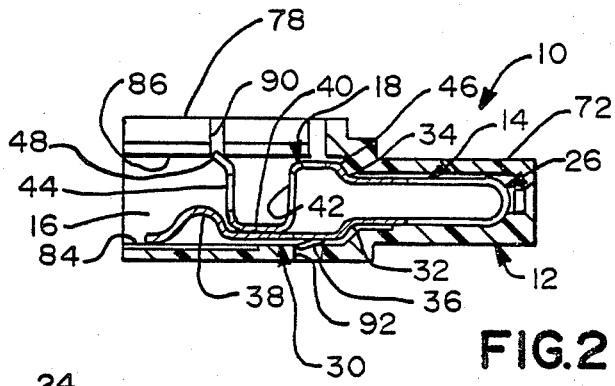
FIG. 2 is a cross-sectional view of the housing and the terminal of FIG. 1 with the terminal installed in the housing cavity.
Figure 3:
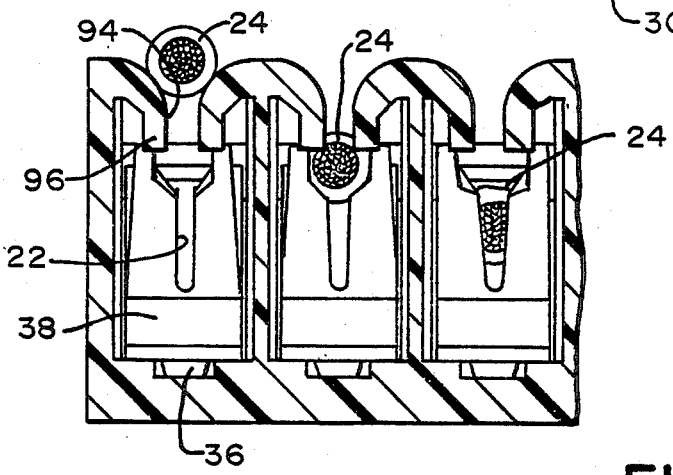
FIG. 3 is a sectional view taken along the line 3—3 of FIG. 1 with terminals installed in the housing cavities showing three stages in the insertion of insulated conductors into the terminals of FIG. 1.

With reference now to the drawings, in FIGS. 1–9 there is illustrated an electrical connector designated as a whole by the reference numeral 10 and constructed in accordance with the principles of the present invention. In general, connector 10 includes an insulated housing 12 and a plurality of similar electrical terminals 14 each adapted to be mounted in a housing cavity 16. Terminal 14 includes an insulated conductor engaging portion or insulation displacement contact structure generally designated as 18 providing a pair of insulation displacement slots 20 and 22 for terminating an insulation clad wire or conductor 24 (FIG. 3). Terminal 14 includes a second contact portion generally designated as 26 for connection to an external contact member (not shown) such as, for example, a contact pin or spade terminal. The insulation displacement contact structure 18 and the contact portion 26 are connected by a connecting portion 28.

In the illustrated embodiment of the invention, terminal 14 further includes a support portion generally designated as 30 adapted for engaging a wall of the cavity 16. A bend or stop portion 32 and 34 is formed in the support portion 30 and the connecting portion 28, respectively, for positioning the terminal within cavity 16. A locking tab 36 is formed in the support portion 30 for retaining the terminal 14 within the cavity 16. An arcuate wire protecting portion 38 is formed in the support portion 30 adjacent the insulation displacement contact structure 18 to limit the downward movement of the wire 24.

Insulation displacement contact structure 18 includes a generally flat, planar base portion 40 from which a pair of legs 42 and 44 extend upwardly (in the orientation shown in the drawing). The legs 42 and 44 together with the base 40 form a generally U-shape for the contact structure 18. Each of the insulation displacement slots 20 and 22 is provided with a beveled entry portion in an upper portion 46 and 48 of the legs 42 and 44, respectively, to facilitate entry of the wires 24. The connecting portion 28 extends from the upper portion 46 of the upstanding leg 42. The upper portion 48 of the leg 44 forms a free end of the terminal 14.

Figure 4:
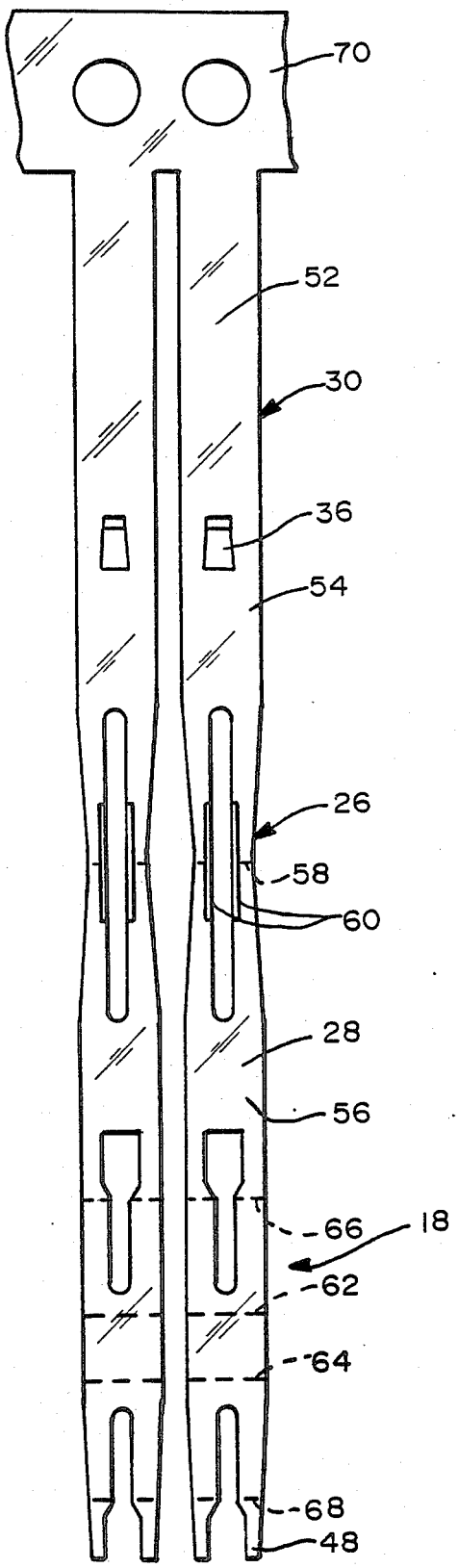
FIG. 4 is an elevational view of a blank from which the terminal of FIG. 1 may be formed.
Figure 5:
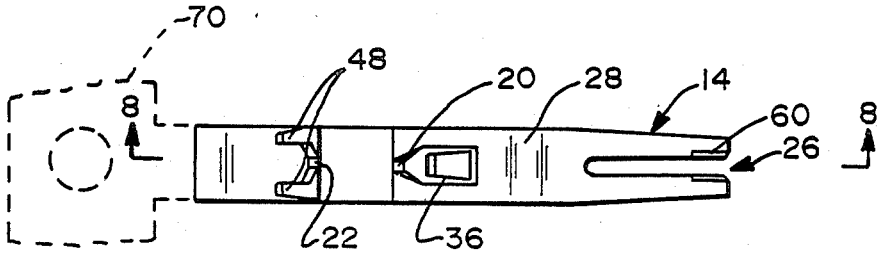
FIG. 5 is a top elevational view of the terminal of FIG. 1 attached to a carrier strip shown in dotted line.
Figure 7:
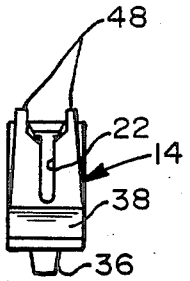
FIG. 7 is an end elevational view of the terminal of FIG. 5.
Figure 6:
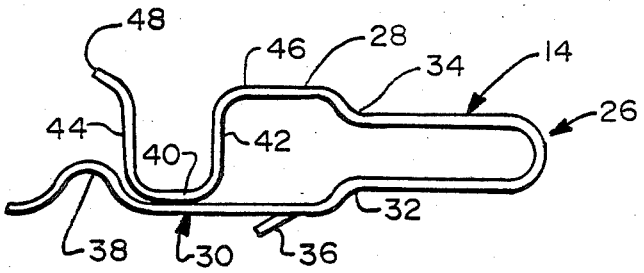
FIG. 6 is a side elevational view of the terminal of FIG. 5.
Figure 9:
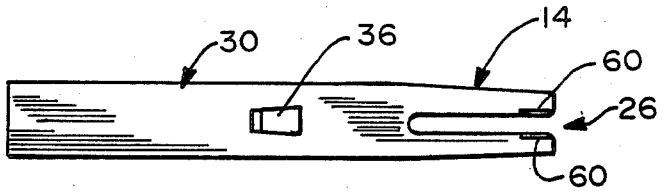
FIG. 9 is a bottom elevational view of the terminal of FIG. 1.
Figure 8:
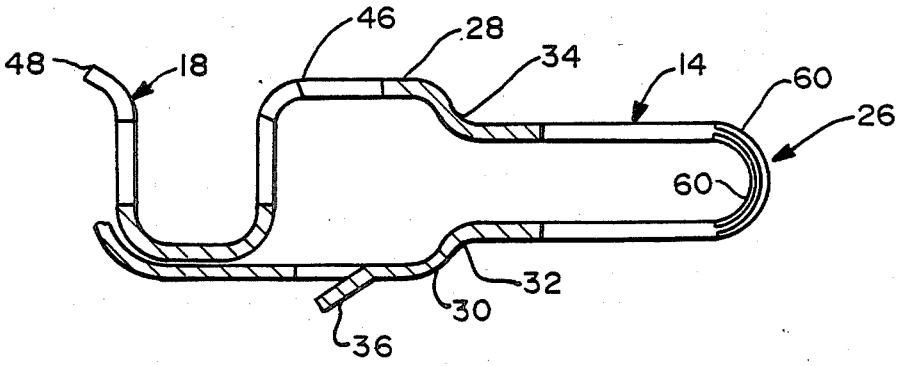
FIG. 8 is a sectional view taken along the line 8—8 of FIG. 5.

As illustrated in FIG. 4, terminals 14 are preferably made by means of progressive stamping and forming operations from a blank of sheet metal stock. The insulation displacement contact structure 18, the connecting portion 28, the contact portion 26 and the support portion 30 are formed as segments of a single, one-piece, continuous strip of metal aligned perpendicular to the longitudinal direction of the sheet metal stock. As a result of the terminal configuration of the present invention, the width of terminal 14 is very small, permitting close center-to-center spacing of the terminals 14 along the sheet metal stock and in the connector 10.

Support portion 30 of each terminal 14 lies in the flat plane of the stock. Wire protecting portion 38 has an arcuate shape provided by bending the strip of metal in the region 52. The stop portions 32 and 34 are formed by bending the strip of sheet metal in regions 54 and 56. Contact portion 26 has a generally C-shape that is formed by bending the strip metal along a fold line 58. Contact portion 26 includes coined sections 60 to facilitate receiving the external contact member.

The U-shaped insulation displacement contact structure 18 is formed by bending the strip of metal along fold lines 62 and 64 to form the upwardly extending legs 42 and 44. The upper leg portions are formed by bending the strip of metal along fold lines 66 and 68.

Prior to insertion of terminals 14 into cavity 16, the terminals are preferably interconnected in closely spaced, parallel relationship by a carrier strip 70 formed from the original sheet metal stock. This permits economical gang assembly of terminals within the connector housing 12. Since the width requirement of terminals 14 is extremely small, the terminals can be provided in strips with the same close center-to-center spacing as cavities 16 within the housing 12.

Connector housing 12 may be formed as a unitary or single-piece molded member of an electrically insulating plastic material. The housing 12 includes a nose portion 72 for receiving external contact members (not shown) engageable with the contact portions 26. A flange 76 separates a rear housing portion 78 from the nose portion 72. The rear housing portion 78 includes a wire receiving face 80 and a terminal receiving face 82.

A row of cavities 16 is provided within the housing 12. Each cavity 16 includes a base wall 84, an opposed wall 86 and side walls 88. Each cavity 16 extends continuously through the axial dimension of the housing 12 from the terminal receiving face 82 through both the rear portion 78 and the nose portion 72. Terminals 14 are aligned with an inserted into the cavity 16 through the terminal receiving face 82 as illustrated buy one terminal 14 in FIG. 1. A recess or groove 90 in interior cavity wall 86 receives the terminal end portion 48 to retain the terminal 14 within the cavity 16. Base wall 84 has a recess or groove 92 for receiving the terminal locking tab 36 further for retaining the terminal within the cavity 16.

Wire receiving face 80 has a plurality of wire receiving openings 94 communicating with the cavity 16. Openings 94 are funnel shaped and defined by strain relief finger members 96 to facilitate receiving and retaining the wires 24 within the insulation displacement slots 20 and 22. As illustrated in FIG. 3, insulated conductors 24 are aligned with the wire-receiving openings 94 and are forced downwardly laterally of their longitudinal axis to be received and terminated within the slots 20 and 22.

Although the present invention has been described in connection with details of the preferred embodiment, many alterations and modifications may be made without departing from the invention. It should be understood that terminals 14 constructed in accordance with the principles of the present invention may be used with connectors of many different sizes, types and configurations. Accordingly, it is intended that all such alterations and modifications be considered within the spirit and scope of the invention as defined in the appended claims.

We claim:

1. A unitary, integrally-formed electrical terminal adapted to be mounted in a connector housing cavity for interconnecting an insulated conductor and a contact member, said terminal being a continuous strip of metal having an insulation displacement contact portion adapted to receive the insulated conductor, a second contact portion adapted to make electrical contact with the contact member, and a connecting portion extending between said insulation displacement contact portion and said second contact portion, and the improvement characterized by:

said insulation displacement contact portion being generally upwardly directed U-shaped with a lower base and spaced first and second upstanding legs;

said connecting portion extending from an upper end of said first leg;

a first insulation displacement slot in said first leg extending into said connecting portion and downwardly from the upper end of the first leg toward the base; and a second insulation displacement slot in said second leg extending downwardly from an open upper end of said second leg toward the base;

whereby an electrical terminal including an in-line insulation displacement contact portion having small space requirements is provided.

2. An electrical terminal as recited in claim 1 wherein said connector housing cavity is defined by cavity walls with a cavity entrance for receiving the insulated conductor in one cavity wall, said one cavity wall having a groove for receiving and retaining said second leg open end.

3. An electrical terminal as recited in claim 1 wherein said insulation displacement contact portion is an end segment of said strip.

4. An electrical terminal as recited in claim 1 wherein said strip is relatively long and narrow thereby enabling multiple ones of said strips to be formed at a predefined progression on a carrier strip.

5. An electrical connector for interconnecting an insulated conductor and a contact member, said connector comprising a housing defining a cavity adapted to separately receive both the contact member and the insulated conductor, a unitary integrally formed electrical terminal in said cavity, said terminal being a continuous strip of metal having an insulation displacement contact portion adapted to receive the insulated conductor, a second contact portion adapted to make electrical contact with the contact member, and a connecting portion extending between said insulation displacement contact portion and said second contact portion, and the improvement characterized by:

said insulation displacement contact portion being generally an upwardly directed U-shape with a lower base and spaced first and second upstanding legs;

said connecting portion extending from an upper end of said first leg;

a first insulation displacement slot in said first leg extending into said connecting portion and downwardly from the upper end of the first leg to its base; and a second insulation displacement slot in said second leg extending downwardly from an open upper end of said second leg toward the base.

6. An electrical connector as recited in claim 5 wherein said connector housing cavity is defined by cavity walls with a cavity entrance for receiving the insulated conductor in one cavity wall, said one cavity wall having a groove for receiving and retaining said second leg open upper end.

* * * * *